US005303965A

United States Patent [19]

Meehan

[11] Patent Number: 5,303,965

[45] Date of Patent: Apr. 19, 1994

[54] VANDALISM-PROOF LEVER HANDLE SYSTEM FOR LOCKING OR LATCHING DEVICE

[75] Inventor: Ralph J. Meehan, Naperville, Ill.

[73] Assignee: Folger Adam Company, Lemont, Ill.

[21] Appl. No.: 933,253

[22] Filed: Aug. 21, 1992

[51] Int. Cl.[5] ..... E05B 3/00

[52] U.S. Cl. ..... 292/336.3; 74/526; 16/DIG. 24; 292/DIG. 30

[58] Field of Search ..... 292/336.3, 1.5, DIG. 30, 292/DIG. 54, DIG. 45, 357, DIG. 60, DIG. 53, 347, 173, 126; 49/460; 74/526, 543; 16/113, DIG. 24, DIG. 32

[56] References Cited

U.S. PATENT DOCUMENTS

| | | | |
|---|---|---|---|
| 26,809 | 1/1860 | Belfield | 292/126 |
| 381,740 | 4/1888 | Wollensak | 292/DIG. 30 X |
| 385,906 | 7/1888 | Chase | 292/DIG. 30 X |
| 975,037 | 11/1910 | Hettwer | 292/DIG. 45 X |
| 1,326,450 | 12/1919 | Howard et al. | 292/336.3 X |
| 1,348,882 | 8/1920 | Kleinsmith | 292/336.3 X |
| 1,592,670 | 7/1926 | Marshall | 292/DIG. 30 X |
| 1,876,748 | 9/1932 | Rand, Jr. et al. | 292/173 X |
| 2,054,741 | 9/1936 | Davis | 74/532 |
| 2,348,265 | 5/1944 | Rippingille | 74/526 |
| 2,580,584 | 1/1952 | Nowak | 292/336.3 X |
| 2,857,783 | 10/1958 | Ranck, Jr. et al. | 74/531 |
| 2,883,868 | 4/1959 | Fresard et al. | 74/96 |
| 2,996,296 | 8/1961 | Eshkanian | 268/118 |
| 3,020,076 | 2/1962 | Biondo | 292/336.3 |
| 3,038,757 | 6/1962 | Schulze | 292/336.3 X |
| 3,452,616 | 7/1969 | Nelson et al. | 74/526 |
| 3,500,668 | 3/1970 | Henry | 292/336.3 X |
| 3,765,265 | 10/1973 | Dzus, Jr. | 74/526 |
| 4,078,449 | 3/1978 | Kelly | 74/526 X |
| 4,887,483 | 12/1989 | Vollath | 74/526 |

FOREIGN PATENT DOCUMENTS

| | | | |
|---|---|---|---|
| 527847 | 6/1931 | Fed. Rep. of Germany | 292/173 |
| 714668 | 11/1931 | France | 292/336 |
| 257362 | 9/1926 | United Kingdom | 292/173 |

*Primary Examiner*—Rodney M. Lindsey

*Attorney, Agent, or Firm*—Hill, Steadman & Simpson

[57] ABSTRACT

A vandalism-proof lever handle system for activating a locking or latching device has a U-shaped lever handle having first and second bent end portions with a central or intermediate portion therebetween. A second end portion is secured to a mounting surface and has an extended portion for engaging the lock or latching device for activating the same. The opposite first end portion is movably secured to move in an arc-like path within a curved retaining channel forming an arc segment of given arc length. The first end portion is entrained preferably by a shoulder bolt or collar having a widened end portion. The widened end portion or widened portion of the shoulder bolt is received in an interior of the channel. End portions of the retaining channel form abutments or stop points which limit further movement during rotation of the lever handle. The shoulder bolt or widened collarlike element limits rotational, lateral, vertical, and inward and outward forces placed on the lever handle. Thus, the system is protected against vandalism and excessive forces which may damage the handle system and lock or latch to which it is coupled. A stop member may also be provided in the retaining channel to establish a stop point before reaching an end of the channel.

12 Claims, 2 Drawing Sheets

VANDALISM-PROOF LEVER HANDLE SYSTEM FOR LOCKING OR LATCHING DEVICE

BACKGROUND OF THE INVENTION

The present invention relates to locking devices with lever handles employed in hostile environments such as penal institutions or other environments where the devices and/or handles may be subject to vandalism.

Frequently locking devices are employed in hostile environments where they may be subject to vandalism or excessive abuse, such as in penal building institutions. More specifically, vandalism problems arise where lever style handles are used for actuating the locking devices. Because of the lever action involved, excessive horizontal, vertical, inward, outward, and circumferential forces can be applied to the handle which can cause breakage of the handle and/or the lock system. Because of the lever action of the handle, substantial forces can be applied on the lock mechanism.

SUMMARY OF THE INVENTION

It is an object of the present invention to provide a lever handle system which greatly reduces the possibility of damage to the system, such as in an abusive environment like a penal institution.

It is a further object of the invention to provide a secure lever handle system for a locking device which will interface with a plurality of different types of locking devices without a substantial change in design of the lever handle system.

According to the invention, a U-shaped lever handle has one end mounted adjacent the lock mechanism where rotational forces are to be applied to the lock mechanism via appropriate rotary shafts, for example, which interface with the lock mechanism. The opposite end of the U-shaped lever handle is movably secured and retained in a curved channel. More specifically, a curved enclosed channel is provided which has a radial slot therein. The opposite end of the U-shaped lever handle is guided and secured so that it can freely move along the radial slot but is entrained thereto, preferably by use of a shoulder bolt which is secured to the end face of the lever handle at the second end thereof. The large radial portion of the shoulder bolt is contained within the radial channel, whereas a relatively narrower portion of the shoulder bolt passes through the slot where it attaches to the end face of the lever handle. Preferably the enclosed channel is formed by a stamped embossment in a plate which is mounted on a facing surface, such as an outer surface of a door.

With the invention, the lever handle is protected from damage due to excessive horizontal, vertical, inward, outward, and circumferential forces applied thereto.

DESCRIPTION OF THE PREFERRED EMBODIMENT

Figure 1:
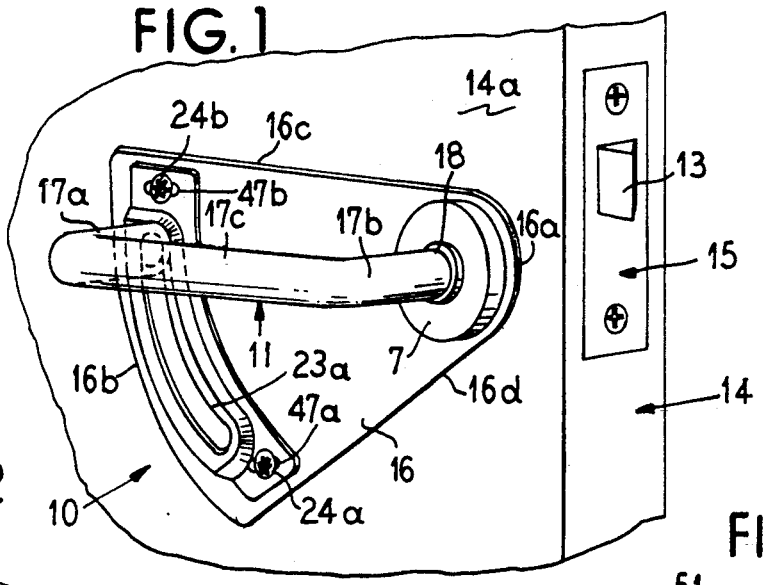
FIG. 1 is a perspective view of the vandalism-proof lever handle system for a locking device according to the present invention.
Figure 2:
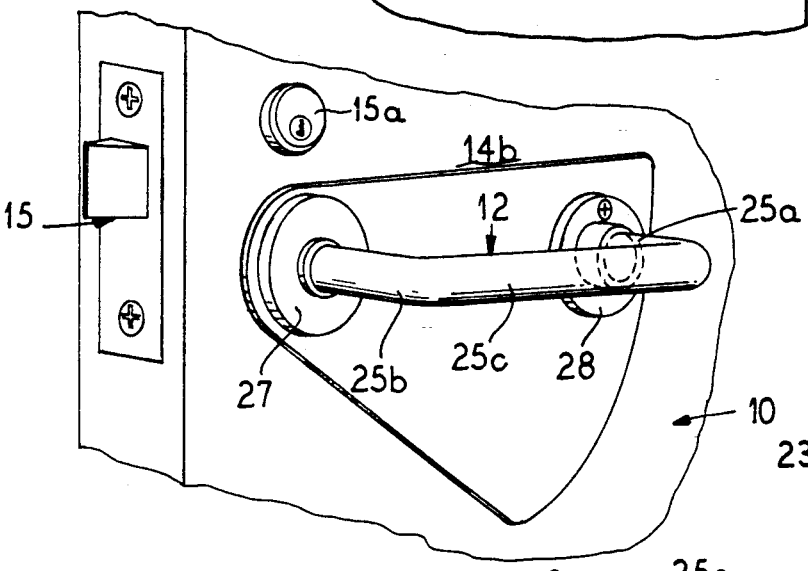
FIG. 2 is a perspective view from an opposite side of a mounting surface shown in FIG. 1 for the lever handle system according to the invention.
Figure 4:
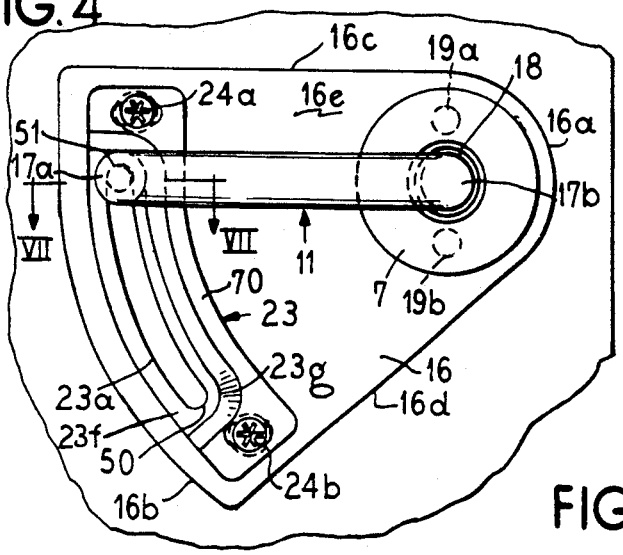
FIG. 4 is a side view of the lever handle system of FIG. 1 according to the invention.
Figure 5:
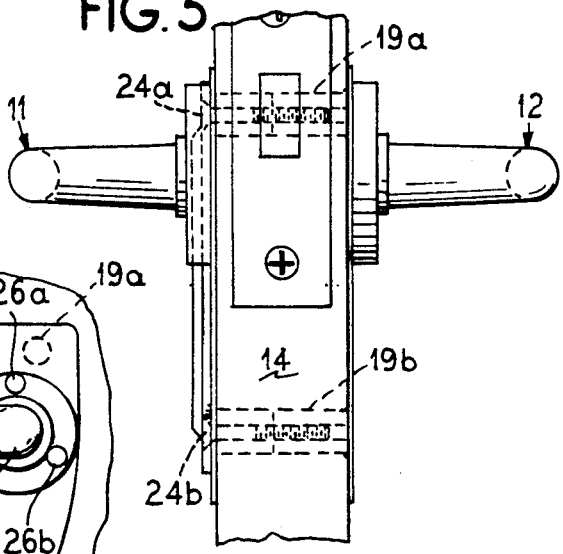
FIG. 5 is an end view of the lever handle system of FIG. 1 according to the invention.

The lever handle system for interaction with a locking device is generally shown at 10 in FIGS. 1 and 2. The system is secured to a wall, door-jamb, door, or the like 14 having opposite faces 14*a* and 14*b*. A lever of the lever handle system is shown at 11 in FIG. 1. A trim plate 16 is also provided which can be manufactured by stamping. Preferably the trim plate 16 has a relatively smaller radial curved section 16*a*, a relatively larger radial section 16*b*, and converging or connecting side edges 16*c* and 16*d*, as most clearly shown in FIGS. *a* and 4. This trim plate is secured to the mounting surface 14*a* by screws 24*a*, 24*b*, 19*a*, and 19*b* as shown in FIG. 4. The screws 24*a* and 24*b* may be received in threaded columns 19*a*, 19*b* shown in FIG. 5.

The U-shaped lever handle 11 has a bent first end portion 17*a* and a bent second end portion 17*b* which are each perpendicular to a substantially straight intermediate portion 17*c*. The second end portion 17*b* passes through an aperture 18 in a fixed circular cup-shaped plate 7 and either connects to a rotating element 6 for a locking element 13 of a lock 15 (see FIG. 3) or has an extended portion for activating the locking element 13. The circular plate 7 preferably has a hollow interior which covers over screws 19*a*, 19*b* shown in FIG. 4 and which may engage portions of the lock assembly 15. Because the nature of the lock assembly 15 may vary, details of this engagement have not been shown. These lock assembly details are not important to the invention.

Figure 7:
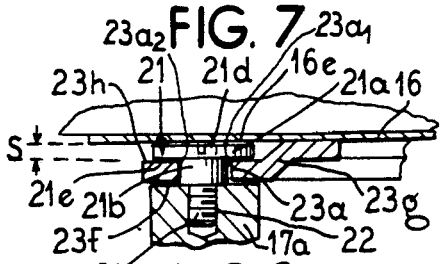
FIG. 7 is a detailed fragmentary view looking down from the top section line VII—VII in FIG. 4.

The first end portion 17*a* of the lever handle 11 is entrained by a so-called shoulder bolt generally shown in detail at 21 in FIG. 7. The shoulder bolt 21 has a relatively large slotted radial portion 21*a* joined to a relatively smaller diameter central radial portion 21*b*. The relatively smaller central radial portion 21*b* has joined to it a still smaller diameter attachment screw portion 21*c* threadedly received within a threaded aperture 22 in the end portion 17*a* of the lever handle 11.

As shown most clearly in FIG. 4, a curved capture or retaining channel 23 is mounted to the trim plate 16 adjacent to the curved radial side edge 16*b* of the trim plate but with a small spacing from the side edge 16*b* thereof. The retaining channel 23 comprises a radial slot 23*a* of a given arc length. The arc length of slot 23*a* is chosen so as to define opposite end positions 30, 31 for the lever handle when the lever handle is rotated. Preferably the retaining channel is formed either as a separate piece or as a stamped embossment in the trim plate 16.

As shown in FIG. 7, the slot 23*a* is defined by opposing slot side walls 23a1 and 23a2 and has a width between said short side just slightly greater than a diameter of the cylindrical central shoulder portion 21*b*. Since the relatively larger diameter shoulder portion 21*a* is retained within the interior space of the channel 23, it is entrained there. The end face 21*d* of the larger shoulder portion 21*a* is closely adjacent to the inner facing surface 16*e* of the trim plate 16 as shown in FIG. 7. Thus, the inwardly directed forces on the lever handle may be stopped when the face 21*d* abuts the inner face 16*e*. Also, the face 21*e* of the shoulder portion 21*a* may strike the inner facing surface 16*f* so as to also restrain the outwardly directed forces on the lever handle 11.

Of course, the longitudinal length of the larger diameter shoulder portion 21*a* is chosen to be slightly smaller than a spacing S within the retainer channel.

An interior space of the retaining channel is preferably circumferentially open in an outwardly facing radial direction relative to the rotated end portion 17*b*.

The retaining channel 23 is preferably secured to the trim plate by retaining screws 24*a*, 24*b* at ends thereof. These screws can be security screws such as TORX. These screws are received in threaded columns 19*a* and 19*b*.

The radius of the arc segment of the slot 23*a* is defined by the radial distance of the slot 23*a* from a center point of the end portion 17*b* of the handle as shown in FIG. 4.

The spacing of the inner surface 23*h* of the retaining channel 23 is set by a transition slanting portion 23*g* which extends up from a plate-shaped flange portion 70 to the ceiling portion 23*f* of the retaining channel. Inner surface 23*h* is formed at the inside of the ceiling portion 23*f*.

As also shown in FIG. 1, retaining screws 24*a*, 24*b* pass through slots 47*a*, 47*b*, respectively. These slots permit adjustment of the retaining channel 23, assuming that the retaining channel 23 is separate from the trim plate 16. This then allows for different lengths of the lever handle 11 resulting in different length radii for the handle swing.

Figure 1A:
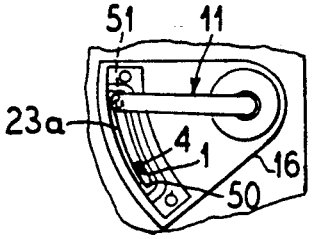
FIG. 1A is an alternate embodiment of FIG. 1 wherein a stop member is provided in a slot for setting specific angular swing of the lock lever handle.

In an alternate embodiment shown in FIG. 1A, a collarlike bushing 1 having a screw head 4 therein is provided in the slot 23*a* at a desired position near but spaced from the end position 50 of the retaining channel slot 23*a*. Preferably, the bushing or collar 1 extends up and through the slot 23*a* and terminates slightly above the slot 23*a*. The screw 4 may be screwed directly into the door through an aperture in the trim plate 16. Alternatively, of course, a screw with a screw head only could be provided which extends up through the slot. By providing the bushing 1 which serves as a stop member, or by providing a screw head only, the length of the radial arc swing of the lever handle can be specifically set to accommodate various lock designs. Furthermore, this allows a precise setting of the lever handle swing so that a stop point which is somewhat less than the total design lever handle swing of the lock being employed may be set. Thus, the lock is further protected since it never reaches its inherently designed lever swing end point. The same can be true by proper selection of the end point 51 in the slot 23*a* so as to prevent the lock from ever actually reaching each of its inherently designed end points for lever or handle swing.

Figure 1B:
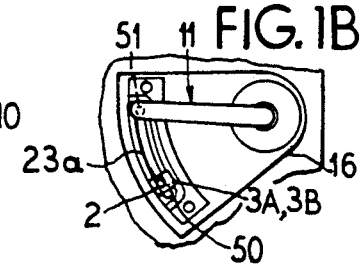
FIG. 1B is an alternate embodiment of FIG. 1A wherein the stop member is adjustable.

FIG. 1B is an alternate embodiment of FIG. 1A wherein an adjustable stop member is provided formed of upper and lower parallel plates 3*a*, *b* connected by a bolt and screw arrangement 2. By loosening the screw arrangement 2, the two plates can be slid along the slot 23*a* and the stop point can be thus freely adjusted.

Figure 3:
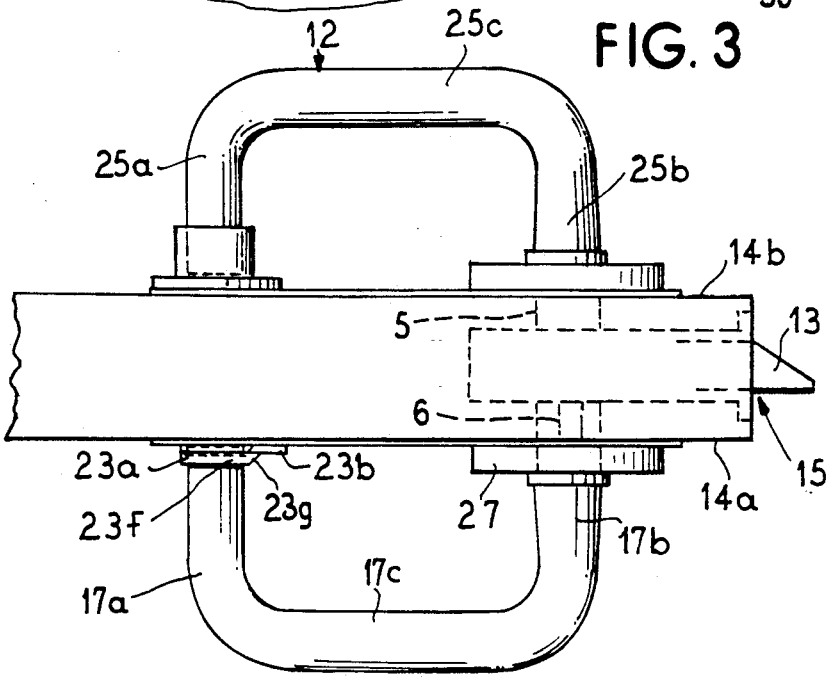
FIG. 3 is a top plan view of the lever handle system according to the invention.
Figure 6:
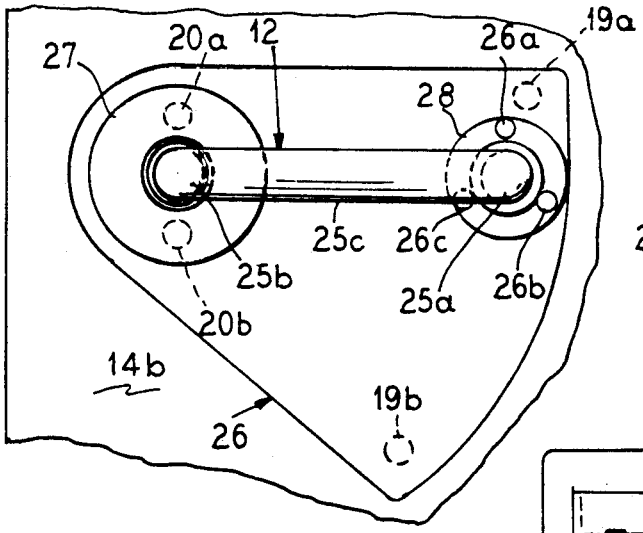
FIG. 6 is a side view of a mounting surface opposite that of FIG. 4 and containing a part of a lever handle system according to the invention.

As shown in FIGS. 2, 3, and 6, at the opposite side of the door 14, that is at opposite surface 14*b*, a non-movable U-shaped lever handle 12 having dimensions which are preferably very similar to the lever handle 11 is provided. This lever handle is preferably mounted on a trim plate 26 having a mirror image shape relative to that of the trim plate 16. A circular cup-shaped plate 27 similar to the plate 7 is also provided at a first bent end portion 25*b* of the handle 12. An additional circular cup-shaped plate 28 of a smaller diameter than the circular plate 27 may be provided at a second bent end portion 25*a* of the handle 12. Mounting screws 26*a*, *b*, *c* may be provided in the circular plate 28. They are preferably attached to the mounting surface 14*b*. A handle central portion 25*c* is provided intermediate and perpendicular to end portions 25*a*, 25*b*.

The end 25*b* of the handle 12 may be secured to the mounting plate 28. Alternatively, the plate 28 may be dispensed with and the end portion 25*a* can be left free so as to permit rotation of the handle 12 on shaft 5 linked to the shaft 6 through lock assembly 15 only generally shown in FIG. 3. Thus, the two handles 11 and 12 would be linked and would turn together with the handle 11 and channel 23 defining the end positions of the handle 12.

The lock 15 such as shown in FIG. 2 can be of a variety of types and may have a key receiving portion 15*a* such as shown in FIG. 2 and which is spaced above the end 25*b* of the lever handle 12.

Figure 8:
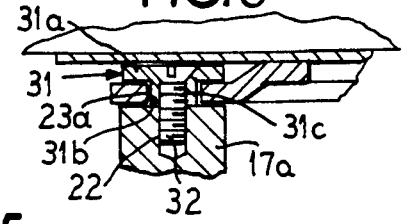
FIG. 8 is a detailed fragmentary view looking down from the top and showing an alternate embodiment of the portion of the system shown in FIG. 7.

In an alternate embodiment shown in FIG. 8, in lieu of an integral or one-piece shoulder bolt 21 as illustrated in FIG. 7, a shoulder bushing 31 having a large diameter portion 31*a* and an extended collar-like intermediate and narrower diameter portion 31*b* is provided. The narrow intermediate diameter portion 31*b* is received within the slot 23*a* and has a longitudinal length slightly larger than the thickness of the slot 23*a*. An aperture 31*c* is provided in the bushing collar 31 to receive a screw 32 which is threaded into an aperture 22 in the end portion 17*a* of the lever handle. The screw 22 thus retains the bushing collar 31 to the end portion 17*a*.

Figure 9:
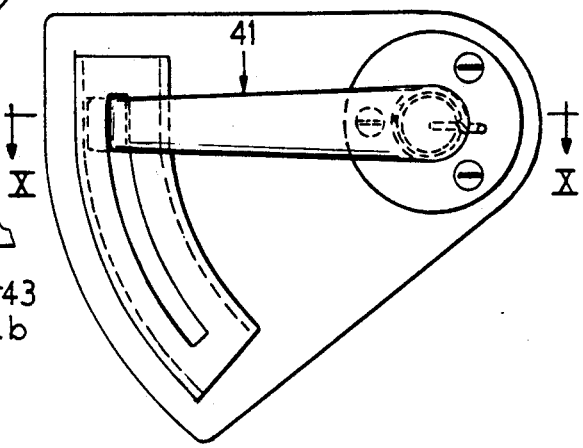
FIG. 9 is a side view of the lever handle system according to an alternate embodiment of the invention.
Figure 10:
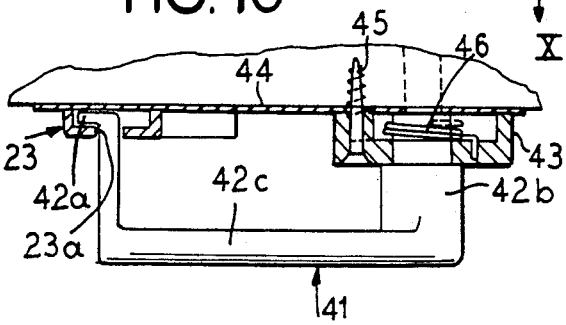
FIG. 10 is a top cross-sectional view taken along section line X—X in FIG. 9.

In an alternate embodiment of the invention shown in FIGS. 9 and 10, a lever handle 41 has a central portion 42*c* joined with a bent end portion 42*a* received through slot 23*a* and retained within an interior space of the channel 23. The thickness of the end portion 42*a* is comparable to a thickness of an interior space of the channel 23. At the opposite end of the lever handle 41 an enlarged cylindrical portion 42*b* is provided received in a cupshaped plate 43 retained by screws 45 to the trim plate 44. A coil spring 46 provides spring loading for the handle 41. The coil spring 46 is received within an interior space of the cup-shaped plate 43.

The central portion 42*c* of the handle 41 is preferably of an oval cross section or a rectangular cross section.

The spring 46 provides biasing for the handle so that it is biased such as in an upwardly position at an upper end of the channel 23.

With the invention, lateral forces applied to the handle are absorbed, and no bending moment is allowed to be imposed on the lock spindle as a result of the end positions 50, 51 defined by the slot 23*a*.

The present invention prevents excessive forces from being applied to lock mechanisms. Even more importantly, in a penal atmosphere, it prevents physically breaking off the lever for use as a weapon or tool.

Although various minor changes and modifications might be proposed by those skilled in the art, it will be understood that I wish to include within the claims of the patent warranted hereon all such changes and modifications as reasonably come within my contribution to the art.

I claim as my invention:

1. A vandalism-proof lever handle system for a building door, having a mounting surface comprising:

locking or latching device;

a U-shaped lever handle having first and second end portions;

means for attaching the second end portion for activating the locking or latching device as the lever handle is rotated about a rotational axis passing through the second end portion;

a retaining channel extending along a radial arc segment of a defined length adjacent the first end portion of the lever handle, said retaining channel having a ceiling portion for outward spacing from and facing said mounting surface and an arc-like slot in said ceiling portion defined by opposing arc-like slot side walls;

means for moveably securing the first end portion of the lever handle through the arc-like slot to an interior of the retaining channel, said arc-like slot in a region of opposite ends of the arc-like slot defining stop points for stopping rotational movement of the lever handle, and said means for moveably securing also restraining the first end portion of the lever handle to prevent rotational movement beyond said stop points and for restraining the lever handle against horizontal, vertical, inwardly and outwardly directed forces applied to the lever handle;

said means for moveably securing comprising a shoulder member having a first cylindrical relatively large diameter portion positioned within the interior of the retaining channel to be between said ceiling portion and said mounting wall, a connecting relatively small diameter cylindrical portion passing through the retainer channel slot between said opposing slot side walls, and means for attaching the relatively smaller diameter portion at an end face of said first end portion of said lever handle; and mounting slots in the retaining channel for adjustably mounting the retaining channel relative to the first end portion of the lever handle so as to adjust a radial distance of the arc-like slot from the lever handle to the second end portion to permit accurate alignment between the arc-like slot and the first end portion and to permit placement of the arc-like slot dependent upon a length of the lever handle being employed.

2. A system according to claim 1 wherein the building door is a penal institution door.

3. A system according to claim 1 wherein said retaining channel comprises a transition portion connecting said ceiling portion to a plate-shaped flange portion.

4. A system according to claim 3 wherein said retaining channel has an outer open peripheral side facing away from said transition portion.

5. A system according to claim 3 wherein a trim plate is provided for mounting on said mounting surface and said retaining channel is attached to said trim plate by screws passing through said plate-shaped flange portion which extends from said retaining channel.

6. A system according to claim 1 wherein said retaining channel has a plate-shaped flange portion extending therefrom, said plate-shaped flange portion having said mounting slots therein permitting movement of the retaining channel relative to the first end portion of the lever handle prior to tightening mounting screws which pass through the mounting slots.

7. A system according to claim 1 wherein another U-shaped handle having first and second end portions is provided for mounting on an opposite side of said door, and wherein said second end portion is in alignment with said second end portion of said handle on the opposite side of the door.

8. A system according to claim 1 wherein an adjustable stop means is provided adjacent one of the ends of the arc-like slot to set one of said stop points and to thus define a specific angle of rotation of the lever handle through placement of the stop means.

9. A system according to claim 8 wherein said stop means comprises a screw having a screw head passing through the arc-like slot.

10. A system according to claim 8 wherein said stop means comprises a screw with a screw head, and a bushing is provided through which the screw head extends and which bushing extends up into the arc-like slot.

11. A system according to claim 8 wherein said stop means comprises parallel plates having attachment means passing therethrough with one plate lying above the arc-like slot and the other plate lying below the ar-like slot so that by loosening the attachment means, the two plates attached to one another can be moved to a desired selective location along the arc-like slot and then secured by tightening the fastening means so as to set a desired location of one of said stop points.

12. A system according to claim 1 wherein a movable stop means is provided adjacent one of the ends of the arc-like slot so as to set one of said stop points and to define a specific angle of rotation through movement of the stop means.

* * * * *